United States Patent [19]

Katsumi et al.

[11] 4,102,082

[45] Jul. 25, 1978

[54] CAM GRINDING APPARATUS WITH MEANS TO MAINTAIN THE GRINDING SPEED CONSTANT

[75] Inventors: Yasuo Katsumi, Kameoka; Shoei Matsuda, Otsu; Toyojiro Inano, Muko, all of Japan

[73] Assignee: Mitsubishi Jukogyo Kabushiki Kaisha, Tokyo, Japan

[21] Appl. No.: 770,758

[22] Filed: Feb. 22, 1977

[51] Int. Cl.[2] ..... B24B 17/10; B24B 5/42

[52] U.S. Cl. ..... 51/101 R; 51/165.89

[58] Field of Search ..... 51/101 R, 101 LG, 105 SP, 51/165.89

[56] References Cited

U.S. PATENT DOCUMENTS

| | | | |
|---|---|---|---|
| 2,508,998 | 5/1950 | Green | 51/101 R |
| 3,274,736 | 9/1966 | Brokaw | 51/101 R |
| 3,693,297 | 9/1972 | Cann | 51/101 R |

FOREIGN PATENT DOCUMENTS

| | | | |
|---|---|---|---|
| 1,387,113 | 3/1925 | United Kingdom | 51/101 R |

*Primary Examiner*—N. P. Godici

[57] ABSTRACT

A cam grinding apparatus has a base member, a rocking bar rockably mounted on the base member, a master cam shaft rotatably mounted on the rocking bar, and a drive motor for driving the master cam shaft in rotation. A cam shaft to be ground is supported by the master cam shaft so as to have the cam section thereof ground by a grindstone while being rocked by the rocking bar and rotated by the master cam shaft. There is provided at least one device for detecting the rotational angle of the drive motor and for detecting the phase angle of the rocking bar. The apparatus has a rotational speed command device responsive to output signals from the detecting for generating a step-like voltage waveform representing a desired rotational speed of the drive motor, and a rotational speed control device responsive to the step-like voltage waveform for controlling the rotational speed of the drive motor so that the circumferential speed of the cam section of the cam shaft at the contact point between the cam section and the grind stone can be kept substantially constant.

4 Claims, 14 Drawing Figures

CAM GRINDING APPARATUS WITH MEANS TO MAINTAIN THE GRINDING SPEED CONSTANT

The present invention relates to a cam grinding apparatus in which a cam is ground by making use of a rocking bar, and more particularly, to such type of cam grinding apparatus which can grind a cam with a high precision in a short period of time.

In a heretofore known cam grinding apparatus such as illustrated in FIG. 1, a rocking bar 3 is rockably mounted on a base member 1; in bearings 2, a master cam shaft 5 is rotatably supported by a pair of supports 4 projecting upwardly from one end portion of the rocking bar 3, and on the upper surface of the other end portion of the rocking bar 3 is provided a foot-stock 6. Between the master cam shaft 5 and the foot-stock 6 a cam shaft A to be ground is supported so as to be rotated integrally with the master cam shaft 5, and a grindstone 7 for grinding a cam section B of the cam shaft A is in sliding contact with the cam section B. On the outer circumferential surface of the master cam shaft is provided a non-circular master cam 8, and this master cam 8 is in sliding contact with a disc-shaped rotatable cam follower (not shown) urged thereagainst by a spring or the like. Accordingly, when the master cam shaft 5 is rotated by a drive motor 9, the rocking bar 3 supporting the master cam 8 rocks because of the non-circular profile of the master cam 8, and owing to this rocking motion of the rocking bar and the rotation of the master cam shaft 5, the cam shaft A which is to be ground rotates while depicting a similar locus to the profile of the master cam 8. In this way the cam section B of the cam shaft A which is to be ground is subjected to grinding by means of a grindstone 7. In FIG. 1, reference numeral 10 designates a universal joint, and numeral 11 designates pulleys.

However, in the above-described prior art cam grinding apparatus, the master cam shaft 5 is adapted to be rotated at a constant rotational speed, so that the cam section B of the cam shaft A to be ground is also rotated at a constant rotational speed. Therefore, the circumferential speed of the cam section B is larger at an angular position at which the distance from the center of rotation of the cam section B is large, and so, there is a disadvantage that at such portion of the cam section B the time available for grinding by the grindstone 7 is shorter than at other positions resulting in defects such as insufficient grinding.

In view of the above-described disadvantage, in the prior art the defects of grinding such as insufficient grinding have been prevented either by lowering the rotational speed of the cam shaft A which is to be ground and that of the master cam shaft or by increasing the total number of revolutions required for the grinding. However, if such measures are taken, the working time becomes longer and thus the working efficiency becomes poor. There is an alternative method in which the profile of the master cam 8 is given a shape which takes the insufficient grinding into account. However the design of the profile of such a master cam 8 is difficult, so that there occurs another namely that the manufacture of the master cam is laborious and can be done only at a high cost.

Therefore, it is one object of the present invention to provide a cam grinding apparatus in which the circumferential speed of a cam section which is to be ground at the contact point between the cam section and a grindstone is kept substantially constant, whereby the cam section can be ground with a high precision in a short period of time.

Another object of the present invention is to provide a cam grinding apparatus, in which the rotational speed of the master cam shaft is controlled in accordance with the angular position of the cam section of a cam shaft which is to be ground, and thereby any circumferential speed variation of the cam section at the contact point between the cam section and the grindstone is reduced to a minimum, whereby the cam section can be ground in a short period of time without being grinding defects such as insufficient grinding.

According to one feature of the present invention, there is provided a cam grinding apparatus including a base member, a rocking bar rockably mounted on said base member, a master cam shaft rotatably mounted on said rocking bar, and a drive motor for rotatably driving said master cam shaft, the cam shaft to be ground being adapted to be supported by said master cam shaft and to have the cam section thereof ground by a grindstone while being rocked by said rocking bar and rotated by said master cam shaft. Said apparatus comprises at least one means for detecting the rotational angle of said drive motor and means for detecting the rocking phase angle of said rocking bar, rotational speed command means responsive to output signals of said detecting means for generating a step-like voltage waveform representing the desired rotational speed of said drive motor, and rotational speed control means responsive to said step-like voltage waveform for controlling the rotational speed of said drive motor so that the circumferential speed of said cam section of said cam shaft at the contact point between said cam section and said grindstone is kept substantially constant.

The foregoing and other features and objects of this invention will become more apparent by reference to the following description taken in conjunction with the accompanying drawings, in which.

Figure 6:
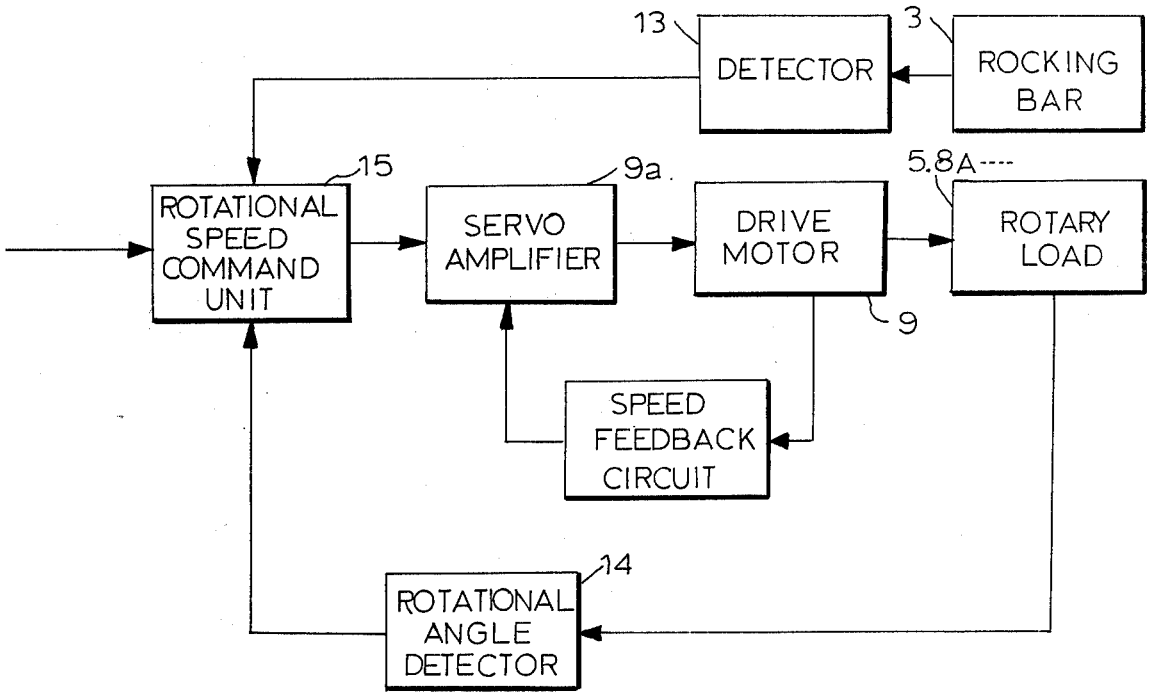
FIG. 6 is a block diagram of a speed control system for the drive motor.
Figure 11:
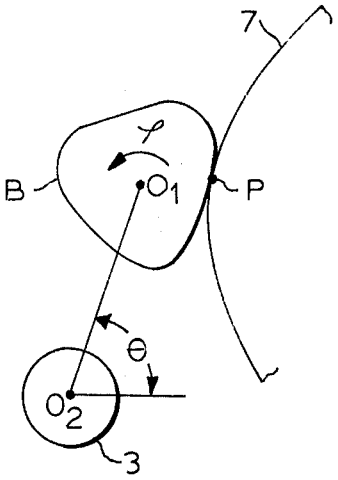
FIG. 11 is a diagrammatic view similar to FIG. 3 for explaining the operation of the cam grinding apparatus according to another preferred embodiment of the present invention which is suitable for grinding a cam having a particular cam profile.
Figure 12A:
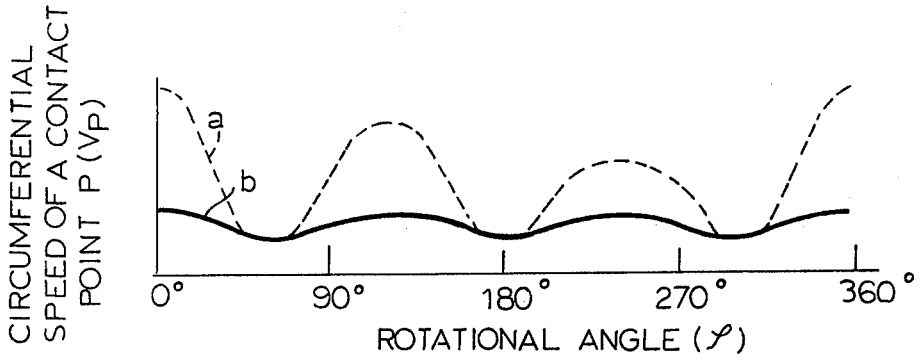
Figure 12B:
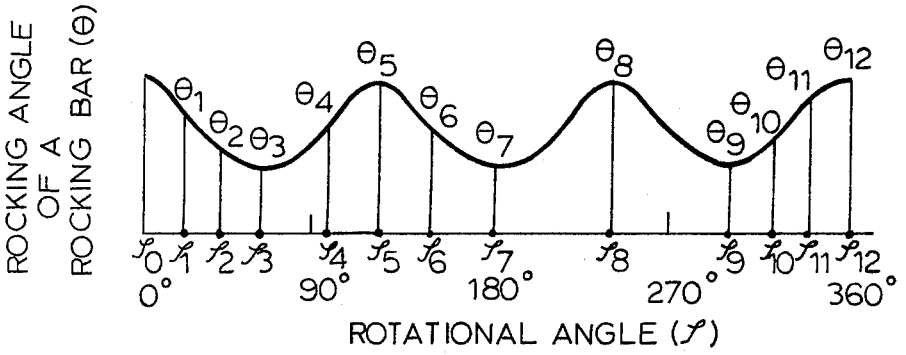
Figure 12C:
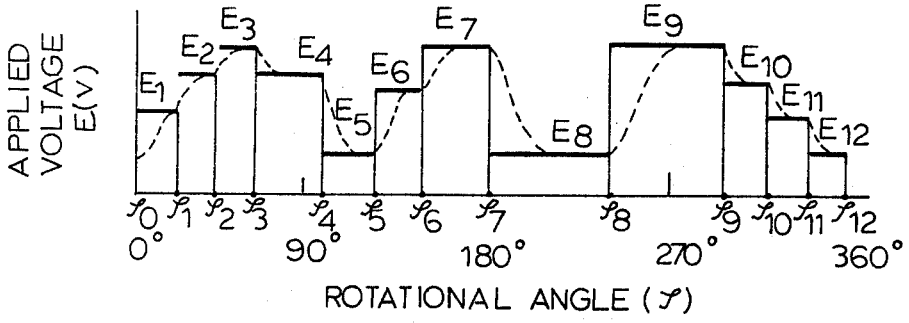

FIG. 12(*a*) is a graphical representation of variations of the circumferential speed of the cam section illustrated in FIG. 11 at the contact point between the cam section and the grindstone as a function of the angular position of the drive motor when the drive motor is rotated at a constant speed (a dash line curve) and when the drive motor is rotated at a controlled speed according to the present invention (a solid line curve);

FIG. 12(*b*) is a graphical representation of the variation of the rocking angle of the rocking bar as a function of the angular position of the cam section; and FIG. 12(*c*) is a schematic diagram showing a step-like voltage waveform generated for the cam profile shown in FIG. 11 by rotational speed command means in the speed control system in FIG. 6 as a function of the rotational angle of the drive motor.

Figure 1:
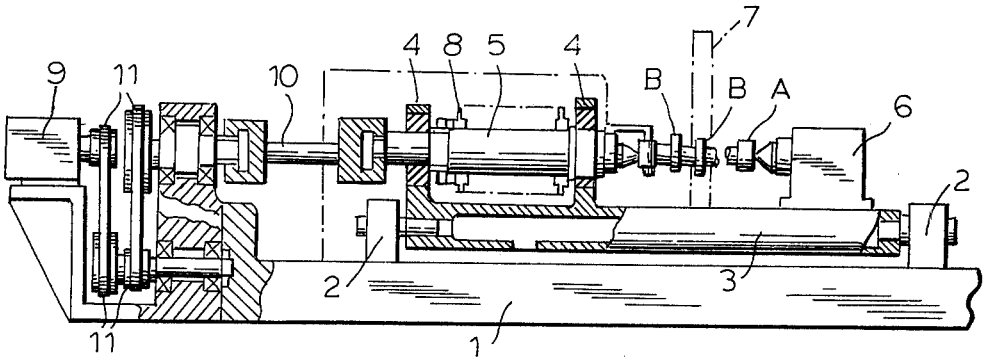
FIG. 1 PRIOR ART
FIG. 1 is a side view partly in cross-section of a prior art cam grinding apparatus.
Figure 2:
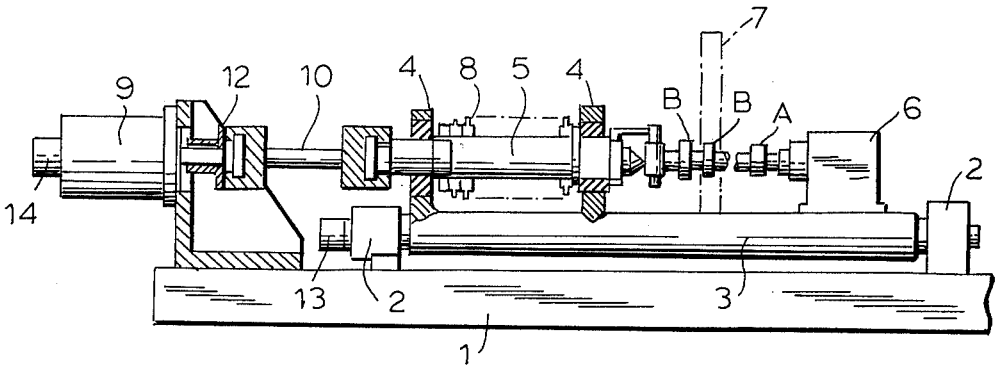
FIG. 2 is a side view partly in cross-section of a cam grinding apparatus according to the present invention.
Figure 3:
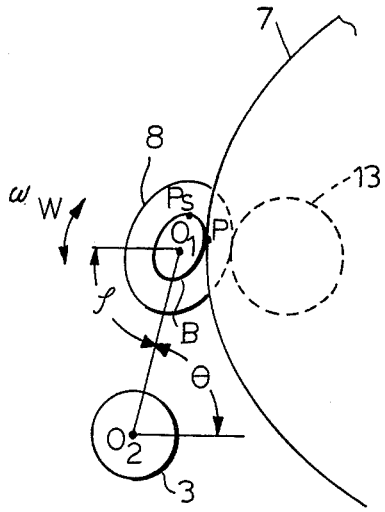
FIG. 3 is a diagrammatic view for explaining the operation of the apparatus shown in FIG. 2.

Referring now to FIG. 2 of the accompanying drawings, a cam grinding apparatus according to one preferred embodiment of the present invention is shown. In this figure, a cam shaft which is to be ground is supported at one end of a master cam shaft 5 that is in turn rotatably mounted on a rocking bar 3, and the other end of the master cam shaft 5 is connected to a drive motor 9 via a universal joint 10 and a fixed joint 12, the structures of these rocking bar 3, the master cam shaft 5, and the associated parts being similar to those of the prior art apparatus shown in FIG. 1. Accordingly, when the master cam shaft 5 rotates, the master cam 8 carries out a sliding movement along the circumferential surface of a cam follower 130 while rotating at an angular velocity of $\omega_w$ about a center of rotation at $O_1$ as shown in FIG. 3, and as a result of this sliding movement, the rocking bar 3 is rocked about a rocking center at $O_2$. Further, due to this rocking motion of the rocking bar 3 and the rotation of the master cam shaft 5, a cam section B of a cam shaft A which is to be ground that is supported on the master cam shaft 5 is subjected to grinding by a grindstone 7 while being rotated about the center $O_1$ and rocked about the center $O_2$.

Figure 4:
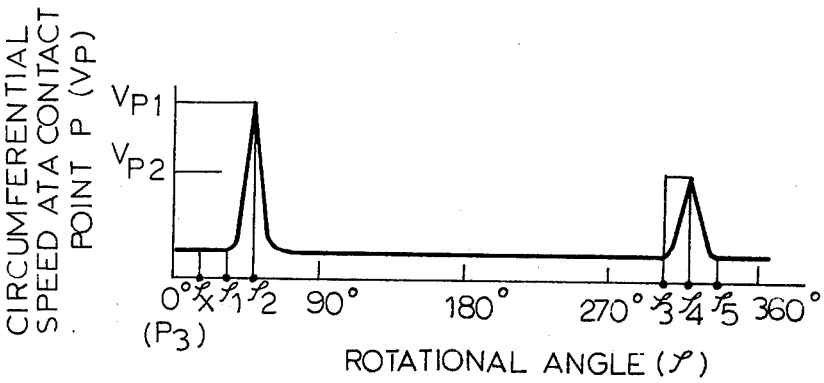
FIG. 4 is a graphical representation of the variation of the circumferential speed of the cam section at the contact point between the cam section and a grindstone as a function of the angular position of the cam section during constant speed rotation of the cam section.

With regard to the circumferential speed $V_p$ of the cam section B at the contact point P between the cam section B and the grindstone 7, if the rotational speed of the master cam shaft 5 is kept constant as is the case with the prior art apparatus, then the circumferential speed $V_p$ at the point P will vary, for example, as shown by the graph in FIG. 4 as the angular position of the cam section B changes through $\phi_1$, $\phi_2$, $\phi_3$, $\phi_4$ and $\phi_5$, and peak values $V_{p1}$ and $V_{p2}$ of the circumferential speed will occur at the angular positions $\phi_2$ and $\phi_4$, respectively. In addition, the rocking angle $\theta$ of the rocking bar 3 (See FIG. 3) will vary within the range of $\theta_0$ to $\theta_2$ as a function of the angular position $\phi$ of the cam section as shown by the graph in FIG. 5.

In the cam grinding apparatus according to the present invention illustrated in FIG. 2, a rocking angle detector 13 is mounted on the rocking bar 3, while a rotational angle detector 14 is mounted on the driving motor 9, and these detectors 13 and 14 are connected to a rotational speed command unit in a control system for the drive motor 9 as shown in FIG. 6. More particularly, when the drive motor (servo motor) 9 is driven by a servo amplifier 9*a*, a rotary load system including the master cam shaft 5, the master cam 8, the cam shaft A which is to be ground, and associated parts is rotatably driven, the rocking angle of the rocking bar 3 which is rocked by the rotational motion of the master cam shaft 5 is detected by the rocking angle detector 13 and the detected signal is transmitted to the rotational speed command unit 15, while the rotational angle of the drive motor is detected by the rotational angle detector 14 and the detected signal is also transmitted to the rotational speed command unit 15, and the rotational speed command unit 15 generates a step-like voltage waveform on the basis of these detected signals and the given profile of the cam to be ground. The generated step-like voltage waveform is applied to the servo amplifier 9*a* which forms a drive circuit for the servo motor 9 jointly with a feedback circuit connected between the servo amplifier 9*a* and the servo motor 9.

Figure 5:
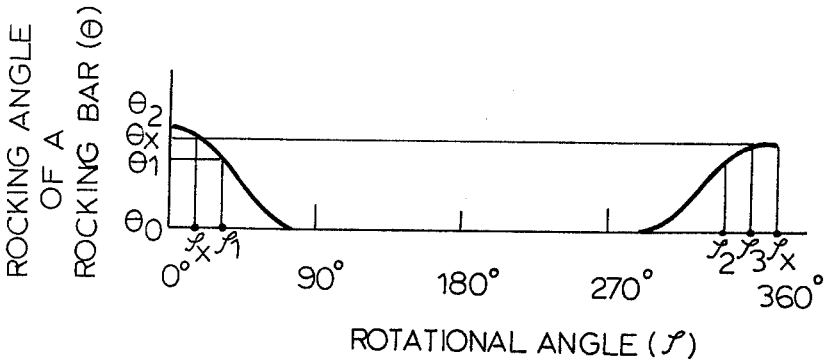
FIG. 5 is a graphical representation of the variation of the rocking angle of the rocking bar as a function of the angular position of the cam section, that is, as a function of the rotational angle of the drive motor.
Figure 7:
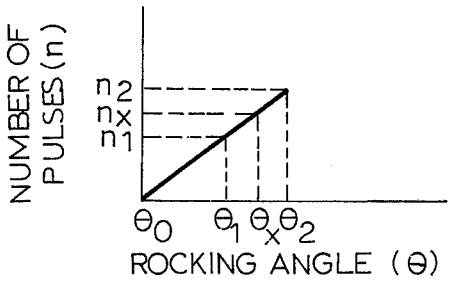
FIG. 7 is a schematic diagram showing the relation between the number of pulses generated by a pulse encoder employed in the means for detecting the rocking phase angle and the rocking angle.

Explaining now the rotational speed control system according to the present invention as illustrated in FIG. 6 in more detail, the above-referred to rocking angle detector 13 serves to determine a reference angular position $\phi_x$ of the cam section B of the cam shaft A which is to be ground on the basis of the detected rocking angle and the given cam profile and to feed a signal representing the reference angular position $\phi_x$ of the cam section to the rotational speed command unit 15, and it can be constructed, for example, of a pulse encoder and a pulse counter. The pulse counter is an up-down counter which counts up and down in response to a positive pulse and a negative pulse, respectively, applied to its pulse input. The pulse encoder generates a positive pulse in response to a predetermined increment of angular displacement in the positive direction in the rocking motion of the rocking bar 3 and generates a negative pulse in response to a predetermined increment of angular displacement in the negative direction in the rocking motion of the rocking bar 3. The output of the pulse encoder is connected to the pulse input of the up-down counter. Therefore, the count $n$ in the up-down counter represents a value proportional to a rocking angle $\theta$ of the rocking bar 3 as shown in FIG. 7. Referring to FIG. 5, if a reference angular position $\phi_x$ for the cam section B is predetermined, the corresponding reference phase angle $\theta_x$ of the rocking motion of the rocking bar 3 is uniquely determined, and therefore, by detecting the corresponding pulse count $n_x$ in the pulse encoder 13, the reference angular position $\phi_x$ of the cam section B can be detected. In the curve of $\theta$ shown in FIG. 5, the points corresponding to a given reference rocking angle $\theta_x$ are found at two angular positions, that is at $\phi_x$ and $\phi_x'$. However, the correct rocking phase angle $\theta_x$ can be uniquely detected by the fact that the rocking phase angle $\theta_x$ is decreasing at the desired angular position $\phi_x$. Therefore, by presetting the rocking angle detector 13 so that an output pulse will be derived when the up-down counter counts the pulse number $n_x$ while it counts down, the rocking angle detector 13 can emit an output pulse which correctly represents the reference rocking phase angle $\theta_x$ of the rocking arm 3 and thus represents the reference angular position $\phi_x$ of the cam section B.

The rotational angle detector 14 has similar construction and function as the above-described rocking angle detector 13, and likewise it can be constructed of a pulse encoder. In the pulse encoder, by counting the number of pulses generated by a pulse generator that is synchronized with the drive motor starting from a reference rotational angle $\phi_x$ of the drive motor 9, that is, the reference angular position $\phi_x$ of the cam section B, the relative rotational angle of the drive motor 9 with respect to the reference rotational angle $\phi_x$ can be detected over a whole revolution.

Figure 8:
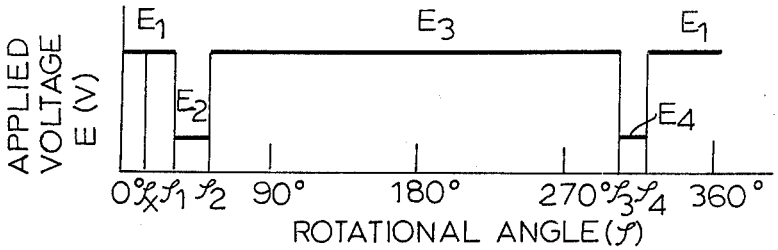
FIG. 8 is a schematic diagram showing a step-like voltage waveform generated by rotational speed command means in the speed control system shown in FIG. 6 as a function of the rotational angle of a drive motor.
Figure 9:
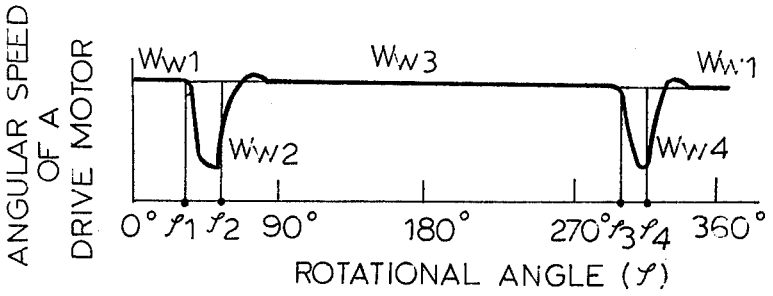
FIG. 9 is a graphical representation of the variation of the angular speed of the drive motor as a function of the angular position of the drive motor when the drive motor is speed-controlled according to the step-like voltage waveform in FIG. 8.
Figure 10:
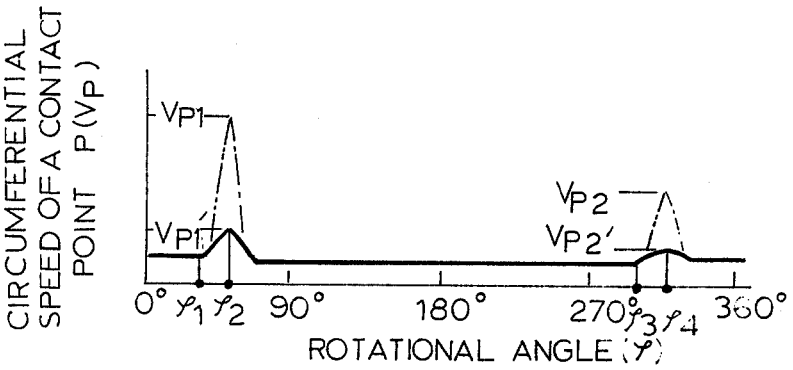
FIG. 10 is a graphical representation of the variation of the circumferential speed of the cam section at the contact point between the cam section and the grindstone as a function of the angular position of the drive motor when the drive motor is rotated at the angular speed illustrated in FIG. 9.

The rotational speed command unit 15 receives a signal representing the reference rotational angle $\phi_x$ of the drive motor 9 from the rocking angle detector 13 and signals representing relative rotational angles of the drive motor 9 from the rotational angle detector 14. It is to be noted that the rotational speed command unit 15 passes the signal representing the reference rotational angle $\phi_x$ of the drive motor 9 to the rotational angle detector 14 to indicate the reference rotational angle $\phi_x$. In response to these received signals, the rotational speed command unit 15 generates a step-like voltage waveform consisting of voltage steps $E_1$, $E_2$, $E_3$ and $E_4$ as shown in FIG. 8, and applies this step-like voltage waveform to the servo amplifier 9*a*. The respective voltage steps $E_1$, $E_2$, $E_3$ and $E_4$ represent desired rotational speeds of the servo motor 9 at the respective steps, and therefore, at the respective steps the drive circuit for the servo motor 9 including the servo amplifier 9*a*, the servo motor 9 and the feedback circuit therebetween tends to accelerate the servo motor 9 towards given desired rotational speeds $\omega_{w1}$, $\omega_{w2}$, $\omega_{w3}$ and $\omega_{w4}$ represented by the respective step voltage $E_1$, $E_2$, $E_3$ and $E_4$ as shown in FIG. 9. Accordingly, when the signal representing the reference rotational angle $\phi_x$ obtained by the rocking angle detector 13 is applied to the input of the rotational speed command unit 15, the voltage $E_1$ corresponding to this reference rotational angle $\phi_x$ is applied to the servo amplifier 9*a* for the servo motor 9. Subsequently, the rotational angles $\phi_1$, $\phi_2$, $\phi_3$ and $\phi_4$ for changing the output voltage are successively detected by the rotational angle detector 14, and in response to these detected signals, the rotational speed command unit 15 changes the voltage applied to the servo amplifier 9*a* for the servo motor 9 through voltages $E_2$, $E_3$, $E_4$ and $E_1$. By controlling the voltage applied to the servo amplifier 9*a* for the servo motor 9 in the above-described manner, the circumferential speed $V_p$ of the cam section B at the contact point P between the cam section B and the grindstone 7 can be varied as a function of the rotational angle of the drive motor 9 as represented by a solid line curve in FIG. 10, so that the peak values of the circumferential speed $V_{p1}$ and $V_{p2}$ in FIG. 4 (also represented by a chain line curve in FIG. 10) are reduced to $V_{p1}'$ and $V_{p2}'$, respectively, and thus the circumferential speed of the cam section B at the contact point P can be maintained substantially constant.

It is to be noted that normally a plurality of cam sections B are provided on the same cam shaft A to be ground, and though the phases of these cam sections are different from each other, the reference rotational angles $\phi_x$ of the respective cam sections B can be separately detected by the rocking angle detector 13.

In a modified embodiment of the present invention, in place of the pulse encoder, for example, a potentiometer the output voltage of which is varied in accordance with its angular position, could be employed for detecting the angular position $\phi_x$ of the cam section B. Alternatively, the invention can be practiced by employing a limit switch, a rotary switch or the like, and in essence, any means which can detect the rocking angle of the rocking bar 3 can be employed. In addition, if the necessary rotational speeds and the angular positions where the rotational speed is to be switched corresponding to a given profile of the cam section B are preset in the rotational speed command unit 15, and if the phase differences between the cam sections are preset where there is provided a plurality of cam sections, then the rotational speed of the servo motor 9 can be controlled without providing the rocking angle detector 13, provided that at the start of the operation the phase relationship of the cam section B and the motor is determined from the position of the cam section B by means of a manual switch, a limit switch or the like and at what rotational speed position the given cam section is placed.

If the cam profile of the cam section B has a shape as shown in FIG. 11, that is, has a shape in which the radius of the cam is varying over the whole angular range of 0° to 360°, the rotational angle detector 14 becomes unnecessary. That is, when such a cam section B is rotated at a constant rotational speed, the circumferential speed $V_p$ of the cam section B at the contact point P varies as a function of the angular position $\phi$ of the cam section B as represented by a dash-line curve *a* in FIG. 12(*a*), and the rocking angle $\theta$ of the rocking bar 3 varies as a function of the angular position $\phi$ of the cam section B as shown in FIG. 12(*b*). Therefore, the rocking angle $\theta$ can be detected over the whole angular range of 0° to 360° of the rotational angle $\phi$, so that the rotational angles $\phi_0$, $\phi_1$, $\phi_2$, . . . $\phi_{11}$ in FIGS. 12(*b*) and 12(*c*) can be detected by detecting the rocking angles $\theta_0$, $\theta_1$, $\theta_2$, . . . $\theta_{11}$ of the rocking bar 3, without providing the rotational angle detector 14, and the rotational speed of the servo motor 9 can be controlled on the basis of these detected rotational angles $\phi_0$, $\phi_1$, $\phi_2$, . . . $\phi_{11}$. In this case, the rotational speed command unit 15 generates a step-like voltage waveform $E_1$, $E_2$, . . . $E_{12}$ which is changed at the respective rotational angles $\phi_1$, $\phi_2$, . . . $\phi_{11}$ and $\phi_0$ as shown in FIG. 12(*c*), and if the drive circuit for the servo motor 9 is controlled by means of this step-like voltage waveform, then the dash-line curve *a* in FIG. 12(*a*) representing the circumferential speed $V_p$ of the cam section B is flattened into the solid line curve *b* in the same figure, and thus the circumferential speed $V_p$ of the cam section B is substantially equalized. It is to be noted that the dash-line curve in FIG. 12(*c*) represents a variation of the rotational speed of the drive motor 9.

As described above, according to the present invention, since the rotational speed of the drive motor can be varied in accordance with the cam profile of the cam section of the cam shaft A which is to be ground, the circumferential speed of the cam section at the contact point between the cam section and the grindstone can be equalized, and therefore, good effects and advantages can be realized in that grinding which has a high precision and which is free from insufficiently ground portions can be achieved efficiently in a short period of time.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. A cam grinding apparatus comprising a base member, a rocking bar rockably mounted on said base member, a master cam shaft rotatably mounted on said rocking bar, a drive motor connected to said master cam shaft for rotatably driving said master cam shaft, means on said apparatus to mount a cam shaft which is to be ground for being driven by said master cam shaft, a grindstone for grinding the cam shaft which is to be ground while being rocked by said rocking bar and rotated by said master cam shaft, detecting means for detecting at least one of the rotational angle of said drive motor and the rocking phase angle of said rocking bar, rotational speed command means to which said detecting means are connected and responsive to output signals from said detecting means for generating a step-like voltage waveform representing a desired rotational speed of said drive motor, and rotational speed control means connected to said rotational speed command means and to said drive motor and responsive to said step-like voltage waveform for controlling the rotational speed of said drive motor so that the circumferential speed of the cam section of the cam shaft which is to be ground at the contact point between the cam section and said grindstone is kept substantially constant.

2. A cam grinding apparatus as claimed in claim 1, in which said detecting means comprises means for detecting the rotational angle of said drive motor with respect to a reference angular position, and means for detecting the angular position of said drive motor for a given cam profile and relative to the detected rocking phase angle of said rocking bar.

3. A cam grinding apparatus as claimed in claim 1, in which said detecting means comprises means for detecting only the absolute rotational angle of said drive motor, and said rotational speed command means comprises means for generating a step-like voltage waveform representing a desired rotational speed of said drive motor as a function of the detected absolute rotational angle of said drive motor.

4. A cam grinding apparatus as claimed in claim 1, in which said detecting means comprises means for detecting only the rocking phase angle of said rocking bar, the cam profile of said cam section of the cam shaft to be ground having a radius varying over its whole angular range of 0° to 360°, and said rotational speed command means comprises means for generating a step-like voltage waveform representing a desired rotational speed of said drive motor at the absolute rotational angles of said drive motor as a function of the desired cam profile and the detected rocking phase angle of said rocking bar.

* * * * *